US005654268A

United States Patent [19]

Norcia

[11] Patent Number: 5,654,268

[45] Date of Patent: Aug. 5, 1997

[54] ADHESIVE CLEANSING SOLVENTS

[75] Inventor: Michael Albert Norcia, Safety Harbor, Fla.

[73] Assignee: Smith & Nephew United, Inc., Largo, Fla.

[21] Appl. No.: 462,761

[22] Filed: Jun. 5, 1995

Related U.S. Application Data

[60] Continuation of Ser. No. 227,282, Apr. 13, 1994, abandoned, which is a division of Ser. No. 026,867, Mar. 5, 1993, Pat. No. 5,336,207, which is a continuation of Ser. No. 838,466, Feb. 19, 1992, abandoned.

[51] Int. Cl.[6] ..... C11D 7/50; C11D 7/24; B01F 1/00; B08B 7/00

[52] U.S. Cl. ..... 510/134; 510/200; 252/364; 604/289; 604/290; 134/38; 134/40

[58] Field of Search ..... 252/364; 604/289, 604/290; 106/285; 510/134, 200; 134/38, 40

[56] References Cited

U.S. PATENT DOCUMENTS

| | | | |
|---|---|---|---|
| 2,999,265 | 9/1961 | Dunne et al. | 424/443 |
| 4,395,347 | 7/1983 | McLaughlin et al. | 510/278 |
| 4,483,783 | 11/1984 | Albanese | 252/312 |
| 4,673,524 | 6/1987 | Dean | 510/413 |
| 4,919,839 | 4/1990 | Durbut et al. | 510/365 |
| 5,004,502 | 4/1991 | Ramzan | 106/287.13 |
| 5,062,988 | 11/1991 | Dishart et al. | 510/175 |
| 5,188,754 | 2/1993 | Weltman et al. | 510/106 |
| 5,207,838 | 5/1993 | Googin et al. | 134/42 |
| 5,240,884 | 8/1993 | Herrington et al | 501/19 |
| 5,336,207 | 8/1994 | Norcia | 604/290 |
| 5,370,817 | 12/1994 | Weltman et al. | 510/407 |
| 5,416,253 | 5/1995 | Weltman et al. | 510/185 |

OTHER PUBLICATIONS

Industrial Solvents Handbook, 2nd ed. New Jersey, Noyes Data Corporation, 1977, pp. 71, 365, 366, 380; and 383 TP247.5 .M4.

Hawleys, Condensed Chemical Dictionary, 11th Edition, (1987), pp. 788 and 806.

*Primary Examiner*—Joseph D. Anthony

*Attorney, Agent, or Firm*—Larson & Taylor

[57] ABSTRACT

An adhesive cleansing solvent for removing medical adhesive from the skin comprises an oxyalkylene alkyl ether such as dipropylene glycol monomethyl ether and a liquid aliphatic hydrocarbon such as a mixture of $C_{10-11}$ paraffins.

14 Claims, No Drawings

ADHESIVE CLEANSING SOLVENTS

CROSS-REFERENCE TO RELATED APPLICATIONS

This is a continuation of application Ser. No. 08/227,282 filed Apr. 13, 1994, now abandoned which was a divisional application of U.S. Ser. No. 08/026,867, filed Mar. 5, 1993, now U.S. Pat. No. 5,336,207, which was a continuation of application Ser. No. 07/838,466, filed Feb. 19, 1992, now abandoned.

BACKGROUND OF THE INVENTION

This invention relates to solvents and more particularly to cleansing solvents for removing medical adhesives from the skin.

Adhesives are routinely employed to secure medical devices such as non-adherent dressings and catheters to the skin as well as for adhesive dressings. Removal of the device or dressing may leave residual traces of adhesive on the skin. Adhesive residues can be a nuisance particularly if it is required to re-affix a device at the same skin site. Moreover skin trauma may occur when an adhesively secured device is removed. Solvents are traditionally used to facilitate removal of both the adhesive product or device and any remaining residues.

Many solvents act as defatting agents and can cause skin irritation. Irritation and skin trauma is especially prevalent where adhesive products have to be applied repeatedly to the same skin site.

Additionally many of the traditional solvents are flammable and are considered to be dangerous safety hazards.

The most common types of medical pressure sensitive adhesives used for attachment to the skin are based upon two different molecular species. These are the polyisobutylene polymers and polyacrylate copolymers. Typical formulae for polyisobutylene based adhesive systems used for medical devices are described in U.S. Pat. Nos. 3,339,546 and 4,253,460. Polyacrylate adhesives frequently applied to the skin in the form of plastic tapes, bandages, transdermal medical delivery systems and the like are described in U.S. Pat. Nos. 3,691,140 and 4,420,470.

The polyisobutylene polymers have a solubility parameter of about 7.5 cal ½/cm ³/₂ (reference CRC *Handbook of Solubility Parameters and Other Cohesion Parameters*, Barton, 4th Edition 1988, pg 282). The polyacrylate adhesives exhibit approximate solubility parameters of 12 to 13 cal ½ cm ³/₂. Due to the significant difference in solubility parameters between polyisobutylene polymers and the polyacrylate copolymers it would be expected that different incompatible solvent systems would be required to dissolve either of the two polymers. Thus, polyisobutylene is readily soluble in solvents such as hexane or toluene whereas the polyacrylates are readily soluble in esters such as ethyl acetate or ketones such as methyl ethyl ketone. We have now found that the disadvantages of the prior can be mitigated by the use of a single solvent. This invention offers one simple solvent system containing medically safe solvents capable of aiding the removal of adhesive medical devices and their associated adhesive residue from the skin irrespective of whether the adhesive is a polyisobutylene based system or a polyacrylate copolymer based system.

SUMMARY OF THE INVENTION

Accordingly, the present invention provides a medical adhesive cleansing solvent comprising from 40–60% by weight of an oxyalkylene alkyl ether, and from 60–40% by weight of a liquid aliphatic hydrocarbon.

DESCRIPTION OF PREFERRED EMBODIMENTS

Aptly the solvent will have a flash point higher than 100° F.

The liquid aliphatic hydrocarbon for use in the invention aptly comprises paraffins having an alkyl chain of at least 6 carbon atoms. Favourable the liquid aliphatic hydrocarbon will comprise paraffin having alkyl chains of not more than 17 carbon atoms. Suitably the hydrocarbon liquid will comprise paraffins having about 10 or 11 carbon atoms per molecule. A suitable hydrocarbon for use in the invention is heptane. Preferably the aliphatic hydrocarbon will be a mixture of paraffins comprising isoparaffins. Preferred hydrocarbon components will have a flash point of greater than 100° F. A favoured liquid aliphatic hydrocarbon is that sold under the trade name ISOPAR G. This is material is a narrow cut isoparaffinic hydrocarbon mixture with a boiling range of 155°–176° C. and is produced by the Exxon Company. Aptly the ether component of the solvent may be an alkyl ether in which the alkyl group is a lower alkyl group. More preferably the alkyl group has up to four carbon atoms.

The glycol ether may be a monoether or a polyether. Aptly the ether is a diether or a triether. However, more aptly the ether will be a monoether.

The oxyalkylene groups of the ether is aptly lower oxyalkylene, more aptly an alkylene group containing up to 4 carbon atoms. Suitably the alkylene groups will be oxypropylene.

A preferred ether for use in the invention is dipropylene glycol monomethyl ether.

A preferred adhesive cleaning solvent in accordance with the invention consists essentially of a mixture of dipropylene glycol monomethyl ether and an isoparaffinic $C_4$-$C_{11}$ hydrocarbon.

The ratio of ether to aliphatic hydrocarbon can vary over a wide range. Aptly the adhesive cleaning solvent of the invention can comprise from 20 to 90% by weight of the ether component and from 80 to 10% by weight of the hydrocarbon component. Suitably the solvents will comprise from 40 to 70%, more suitably from 45 to 65% by weight of the ether component and from 60 to 30%, more suitably from 45 to 55% by weight of the hydrocarbon component.

A preferred adhesive cleansing solvent of the invention comprises dipropylene glycol monomethyl ether and ISOPAR G in approximately equal amounts by weight. Solvent of this formulation has a solubility parameter of 8.0 cal ½/cm ³/₂ and will effectively remove both polyisobutylene and polyacrylate based adhesives from the skin with essentially no skin trauma occurring.

The adhesive cleansing solvents of the invention may contain other additives such as preservatives, anti-oxidants, fragrances and skin protectants.

The invention will now be illustrated by the following examples.

EXAMPLE 1

An adhesive cleansing solvent was produced according to the following formulation:

| Component | % Wt/Wt | Function |
|---|---|---|
| Arcosolv (R) DPM (Dipropylene Glycol Methyl Ether) | 49.900 | Solvent |
| Isopar G (Isoparaffinic Solvent) | 48.575 | Solvent |
| Aloe Extract | 1.250 | Skin Protectant |
| Givaudan ESC 10,740 (0.05%) Belmay 10139-186 (0.25%) | 0.075 | Fragrance |
| Benzyl Alcohol | 0.10 | Preservative |
| Butylated Hydroxyanisole (B.H.A.) | 0.10 | Anti-oxidant |

This formulation was used to determine its ability to sensitize human skin using the following test procedure.

A 2 $cm^2$ test site was outlined with a gentian violet skin marker on the infrascapular region of the back. A clean, cotton swab was dipped into the formulation and applied immediately to the test site and rubbed for 15 seconds.

The test site was then wiped with a wet gauze pad, dried and covered with an occulusive patch formed from a gauze pad covered with a plastic film adhesive tape. The patch was removed after 24 hours and the test procedure repeated a further 24 hours later after six repetitions of the test, the area within the area of the skin marking was evaluated for both erythema and edema formulations using the Draize test (Draize, J H 1959 Dermal Toxicity, pages 46–59 in Appraisal of the Safety of Chemicals in Goods, Drugs and Cosmetics, The Association of Food and Drug Officials of the United States, Bureau of Food and Drugs, Austin, Tex., USA.)

In over 100 separate tests a temporary barely perceptible erythema was observed in only one case during the induction phase and during the challenge phase no erythema was observed in any of the subjects.

EXAMPLE 2

Formulations were prepared as described in Example 1 except that the ratio of the ether and hydrocarbon components was varied as shown in the following table. The efficacy of the solvent for removing adhesive for each of polyisobutylene and polyacrylate adhesives is expressed as an integer or a scale of 0 to 4.

| Arcosolv (%) | Isopar (%) | Efficacy Isobutylene | Acrylate |
|---|---|---|---|
| 30 | 70 | 3 | 1 |
| 40 | 60 | 3 | 2 |
| 50 | 50 | 4 | 4 |
| 60 | 40 | 3 | 1 |
| 70 | 30 | 2 | 1 |
| 80 | 20 | 2 | 1 |

Scale
0 no solvent effect
1 minimal solvent effect
2 moderate solvent effect
3 good solvent effect
4 excellent solvent effect

I claim:

1. A medical adhesive cleansing solvent comprising from 40–60% by weight of an oxyalkylene alkyl ether which includes an alkyl ether group and an oxyalkylene group, and from 60–40% by weight of a liquid aliphatic hydrocarbon.

2. A medical adhesive cleansing solvent as claimed in claim 1 having a flash point greater than 100° F.

3. A medical adhesive cleansing solvent according to claim 1 wherein the alkylene group of the oxyalkylene alkyl ether contains up to 4 carbon atoms.

4. A medical adhesive cleansing solvent according to claim 1 wherein the oxyalkylene alkyl ether is dipropylene glycol monomethyl ether.

5. A medical adhesive cleansing solvent according to claim 1, wherein said liquid aliphatic hydrocarbon is a narrow cut isoparaffin hydrocarbon mixture with a boiling point range of 155°–176° C.

6. A medical adhesive cleansing solvent according to claim 1, further comprising at least one additive selected from the group consisting of anti-oxidants preservatives, fragrances and skin protectants.

7. A medical adhesive cleansing solvent according to claim 1 wherein the oxyalkylene alkyl ether is an oxyalkylene monoalkyl ether in which the alkyl group contains up to 4 carbon atoms.

8. A medical adhesive cleansing solvent according to claim 7 wherein the oxyalkylene monoalkyl ether is an oxyalkylene monomethyl ether.

9. A medical adhesive cleansing solvent according to claim 1 consisting essentially of from 40 to 60% by weight of dipropylene glycol monomethyl ether, from 60 to 40% by weight of a liquid aliphatic hydrocarbon mixture comprising isoparaffins containing from 10 to 17 carbon atoms, and at least one additive selected from the group consisting of anti-oxidants preservatives, fragrances, and skin protectants.

10. A medical adhesive cleansing solvent according to claim 9, wherein the ether and the hydrocarbon mixture are present in approximately equal amounts by weight.

11. A medical adhesive cleansing solvent according to claim 1 wherein the liquid aliphatic hydrocarbon is a mixture of paraffins.

12. A medical adhesive cleansing solvent according to claim 11 wherein each paraffin contains from 6 to 17 carbon atoms.

13. A medical adhesive cleansing solvent according to claim 12 wherein the mixture of liquid aliphatic hydrocarbons comprises a mixture of isoparaffins.

14. A medical adhesive solvent consisting essentially of from 40–60% by weight of an oxyalkylene alkyl ether which includes an alkyl ether group and an oxyalkylene group, from 60–40% by weight of a liquid aliphatic hydrocarbon, and at least one additive selected from the group consisting of antioxidants, preservatives, fragrances and skin protectants.

* * * * *